US006334400B1

(12) United States Patent
Nien

(10) Patent No.: US 6,334,400 B1
(45) Date of Patent: Jan. 1, 2002

(54) FOLDABLE TABLE

(76) Inventor: Chou-Chin Nien, No. 277, Sec. 2, He Nan Rd., Hsi Tun Zone, Taichung (TW)

( * ) Notice: Subject to any disclaimer, the term of this patent is extended or adjusted under 35 U.S.C. 154(b) by 0 days.

(21) Appl. No.: 09/564,700

(22) Filed: May 4, 2000

(51) Int. Cl.[7] ..... A47B 3/00
(52) U.S. Cl. ..... 108/115; 108/35
(58) Field of Search ..... 108/35, 33, 36, 108/38, 115, 34, 41

(56) References Cited

U.S. PATENT DOCUMENTS 2,086,463 A * 7/1937 Bram
2,269,370 A * 1/1942 Haibeck
2,903,313 A * 9/1959 Block
3,304,891 A * 2/1967 Rachman
3,368,504 A * 2/1968 Cohen
5,357,872 A 10/1994 Wilmore .....

* cited by examiner

*Primary Examiner*—Jose V. Chen
(74) *Attorney, Agent, or Firm*—Browdy and Neimark

(57) ABSTRACT

A foldable table comprises two table tops which are provided in the same side with a hand grip. Two leg supports are pivoted to the undersides of the table tops such that other sides of the leg supports are turned in the undersides of the table tops to join together. Four support frames are fastened in pair with the undersides of the table tops. The adjoining ends of the support frames are provided with two pivoting members, with each having a pivoting member, and a retaining member disposed on a pivoting member for fixing the position of the table tops in the unfolded state. A wrenching member is disposed on the retaining member and is extended out of the pivoting member for causing the retaining member to move.

6 Claims, 4 Drawing Sheets

FOLDABLE TABLE

FIELD OF THE INVENTION

The present invention relates generally to table, and more particularly to a foldable table.

BACKGROUND OF THE INVENTION

The U. S. Pat. No. 5,357,872 discloses a foldable table comprising two table tops 12 which are supported by two support legs 54. The support leg 54 of one of the two table tops 12 is provided with an inner tube 66 which is fastened by a fastening bolt 64. The fastening bolt 64 is apt to complicate the fixation of the support legs 54. The prior art foldable table is not securely constructed.

SUMMARY OF THE INVENTION

The primary objective of the present invention is to provide a foldable table free from the shortcomings of the prior art foldable table described above.

The foldable table of the present invention comprises two table tops, two support legs, two support frames, and one retaining member. The two support legs are fastened pivotally with the undersides of the table tops. The two support frames are mounted in the undersides of the table tops and are pivoted together to enable the table tops to swivel on the pivoting portions. The retaining member serves to locate the support frames at such time when the two table tops are unfolded.

The features and the advantages of the present invention will be more readily understood upon a thoughtful deliberation of the following detailed description of the present invention with reference to the accompanying drawings.

DETAILED DESCRIPTION OF THE INVENTION

Figure 1:
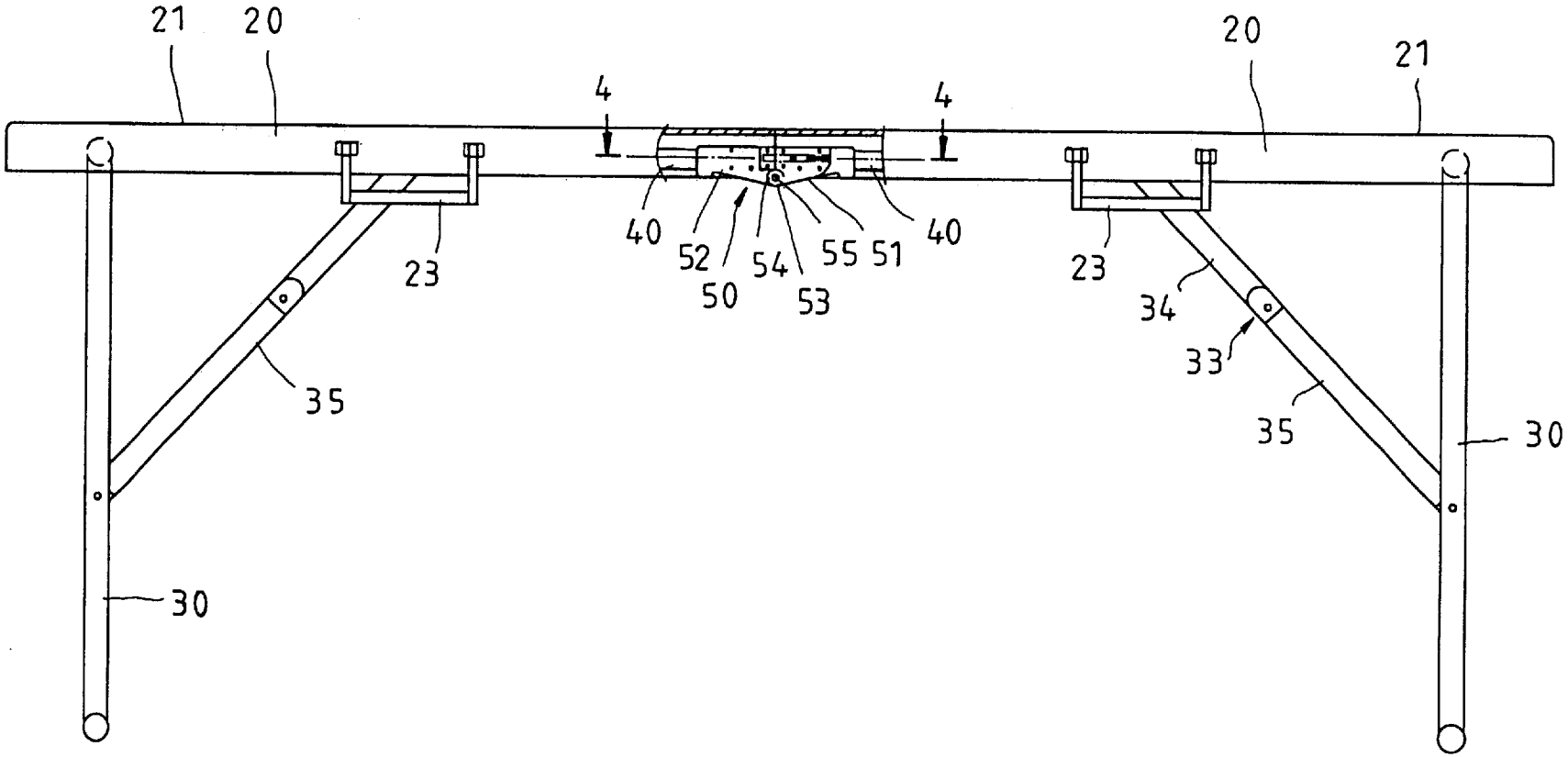
FIG. 1 shows a side schematic view of the present invention in the unfolded state.
Figure 2:
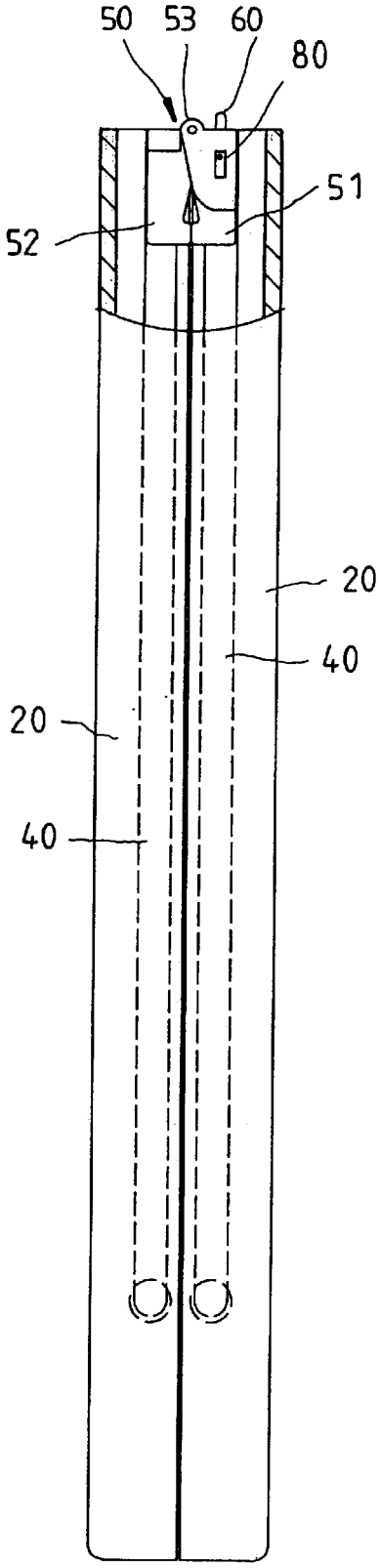
FIG. 2 shows a side schematic view of the present invention in the folded state.
Figure 3:
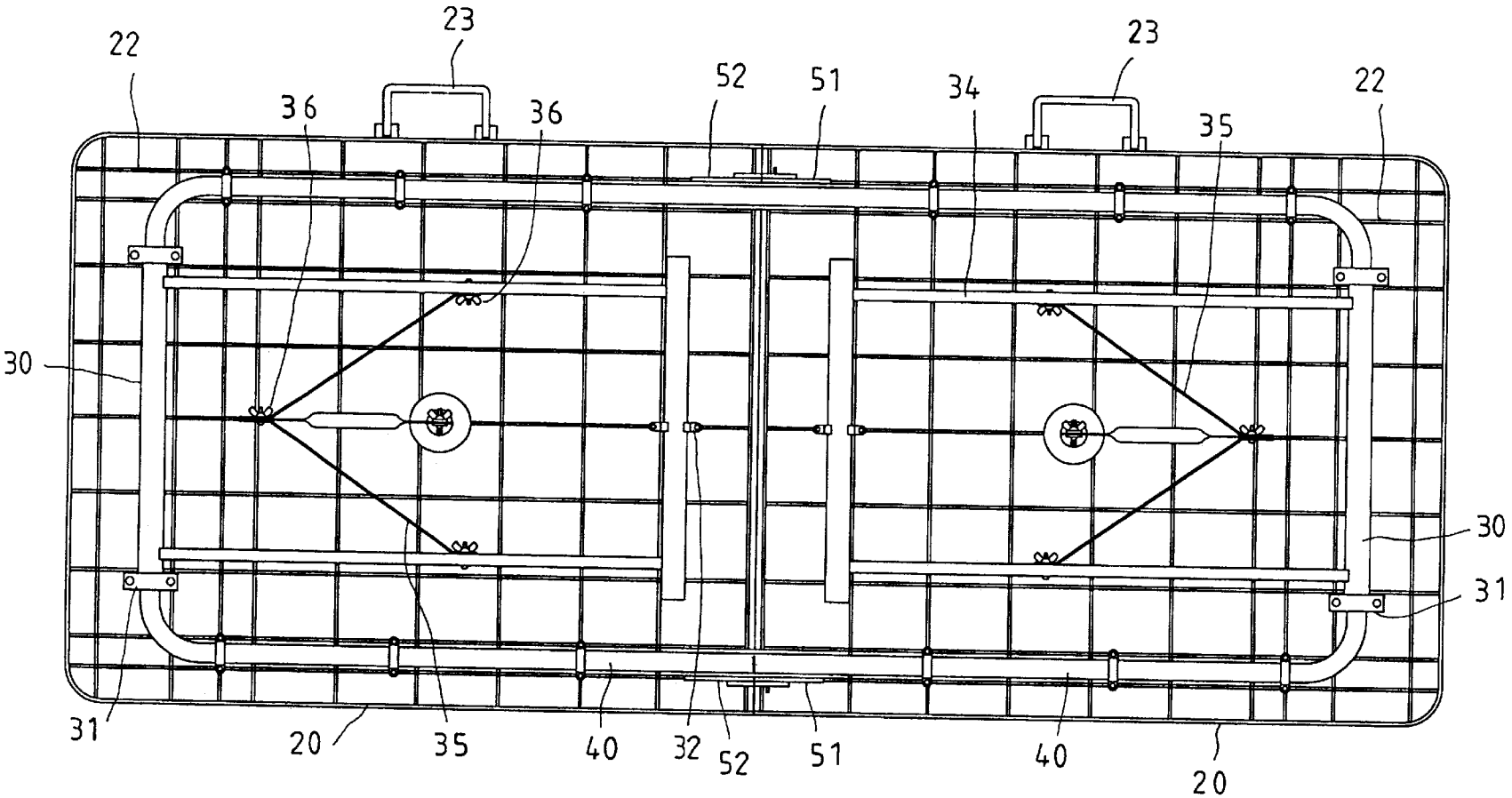
FIG. 3 shows a bottom view of the present invention with the table tops thereof being unfolded and with the support legs thereof being folded.

As shown in FIGS. 1–5, a foldable table embodied in the present invention comprises component parts, which are described hereinafter.

Two table tops 20 are made of a plastic material by injection molding and are provided with a top surface 21. The table tops 20 are provided in the underside with a plurality of reinforcing ribs 22 which are interlaced. The table tops 20 are further provided in the same lateral part with a hand grip 23 fastened therewith.

Two support legs 30 are made of a metal tube and are joined together to form a rectangular frame which is provided in the short side with two fitting pieces 31. These two fitting pieces 31 are fastened in the underside of the table tops such that the fitting pieces 31 are parallel to the short axis of the table top 20, so as to enable the support legs 30 to turn the other short side on the pivoting side acting as a pivot toward the underside of the table top. The short side is retained by a retaining member 32. A folding frame 33 is disposed between each support leg and the underside of the table top and is formed of three connection rods. Two of the connection rods 34 are pivoted at one end thereof with two long sides of the rectangular frame. The third connection rod 35 is pivoted at one end with the underside of the table top, and at other end thereof with other ends of the two connection rods 34 to form a Y-shaped folding frame which is provided at each pivoting point with a bolt 36 for fastening each pivoting point.

Four support frames 40 are mounted in the underside of the table tops 20 such that the support frames 40 are parallel to the longitudinal axis of the table tops 20, and that the ends of the support frames corresponding to the table top are contiguous to each other and are linearly opposite to each other.

Two corresponding support frames are provided with one set of pivoting device 50, which comprises the following parts.

A first pivoting plate 51 and a second pivoting member 52 are two pivoting plates which are fastened at two adjoining ends by soldering so as to enable the ends of the two pivoting members to join together. The two pivoting members are provided in the adjoining ends with a round pivoting portion 53, an axial hole 54 located in the middle. These two pivoting members are pivoted together by the pivoting portions. The axial hole 54 is provided with a shaft bolt 55 to enable the two pivoting members to turn on the shaft bolt. One side of the first pivoting plate is provided with a long receiving slot 511 parallel to the axis of the support frame. The slot 511 extends to the adjoining end surface of the second pivoting member 52. The other side of the first pivoting plate is provided with a long through hole 512 corresponding to the midsection of the long receiving slot and extending along the axial direction of the long receiving slot. The second pivoting member is provided with a retaining slot 521 corresponding to the connection place of the long receiving slot and extending along the longitudinal axis of the receiving slot.

A retaining member 60 is a long bar-shaped retaining slide block, which is disposed in the receiving slot 511 of the first pivoting plate and is capable of moving along the longitudinal axis of the receiving slot. One end of the retaining slide block is inserted into the retaining slot 521 of the second pivoting member, so as to retain the retaining slide block between the two second pivoting members. The retaining slide block is provided in other end with a protruded portion 61. The retaining slide block is provided in one side with a threaded hole 62 corresponding to the through hole of the first pivoting plate.

A spring 70 is disposed in the receiving slot 511 of the first pivoting plate and urges between the slide block 60 and the bottom of the receiving slot. The protruded portion 61 of the slide block is inserted into the spring which is intended to force one end of the slide block to jut out of the first pivoting plate.

A wrenching member 80 is a dial rod which is provided at one end with a threaded section, which is engaged with the threaded hole 62 of the slide block 60 via the through hole 512 of the first pivoting plate 51.

Figure 4:
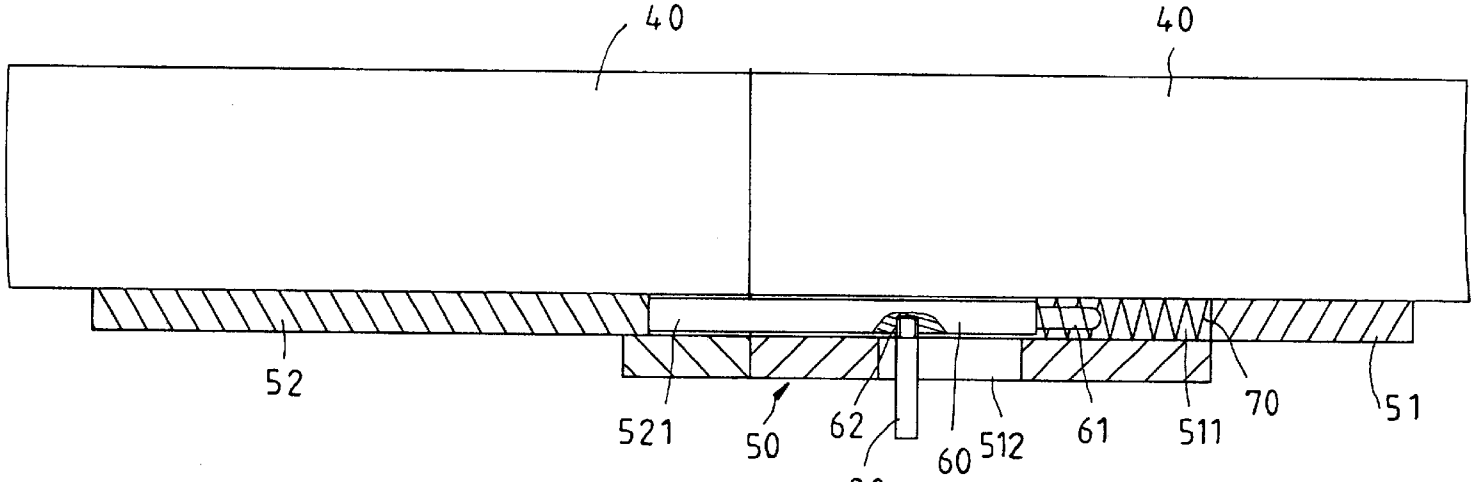
FIG. 4 shows a sectional view taken along the direction indicated by a line 4—4 as shown in FIG. 1.
Figure 5:
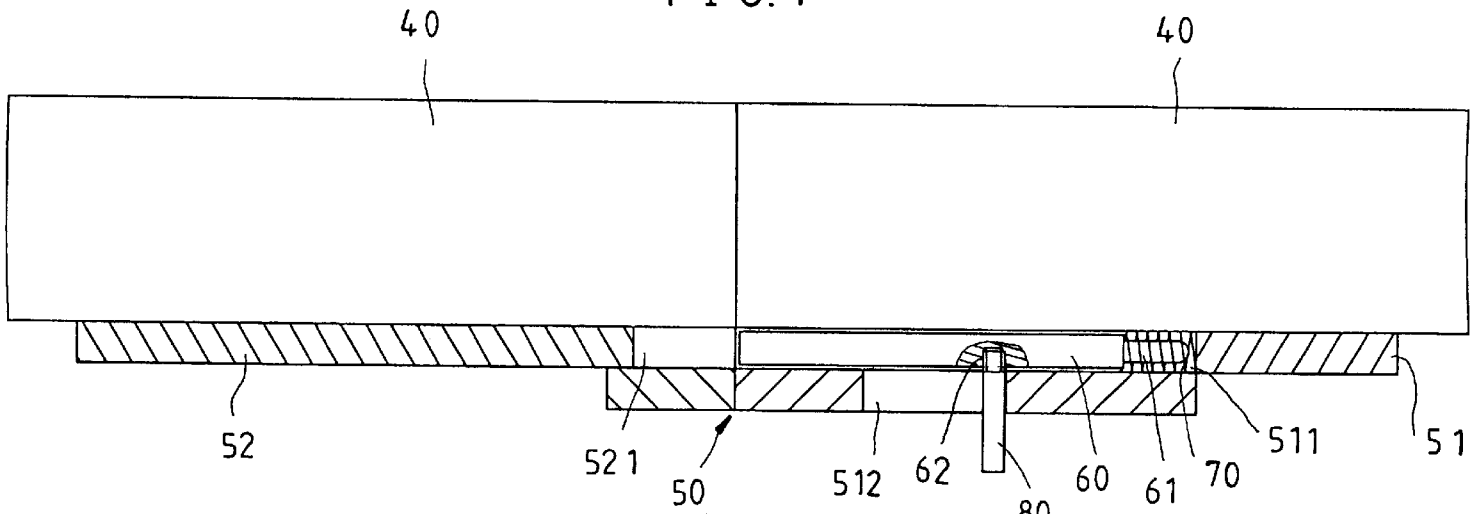
FIG. 5 is similar to FIG. 4 for showing a schematic view of the present invention in the unlocked state.

As shown in FIGS. 4 and 5, when the two table tops are unfolded, the two corresponding support frames 40 turn on the shaft bolt 55 to align, as shown in FIG. 4. As the wrenching member 80 is wrenched inward, the slide block

60 is actuated to move to compress the spring 70 such that the projecting part of the slide block is temporarily retracted into the receiving slot 511 of the first pivoting plate until the adjoining ends of the second pivoting plate 52 and the first pivoting plate come in contact with each other. In the meantime, the projected end of the slide block is forced by the recovery force of the spring to be retained in the retaining slot 521 of the second pivoting plate. As a result, the slide block is retained between the two pivoting members so as to fix the pivoting members and the support frames at an angle of 180 degrees at the time when the two table tops are unfolded. In the process of folding the two table tops, the wrenching member 80 is first wrenched inward to cause the slide block 60 to retract again such that the projected end of the slide block is not jutted out of the first pivoting plate, and that the projected end compresses the spring. The slide block thus moves out of the retaining slot 521 of the second pivoting plate, thereby enabling the two pivoting plates and the support frames 40 to turn freely. The support frames can be thus turned to fold the table tops.

What is claimed is:

1. A foldable table comprising:

a first and second table top rotatably engaged side by side from a folded position into a coplanar operating position;

a leg support rotatable engaged on an underside of each said table top from a folded state on the underside of each said table top to a position supporting the coplanar operating position;

two parallel support frames respectively fixed on the underside of each said table top; wherein the support frames of the first table top abut and are coaxial with the support frames of the second table top when the first and second table top are rotated out of the folded position into the coplanar operating position;

the first and second table top being rotatably engaged by two sets of pivoting devices respectively fixed on a buttable ends of said support frames;

each of the two sets of pivoting devices comprising a first and second member respectively fixed to the abuttable ends of the support frames and engaged together by a pivot;

each first member of the pivoting devices having a retaining member biased by a spring to extend out beyond a corresponding end of the support frame to which the first member is fixed;

each second member having a receiving slot;

wherein said pivoting devices permit said retaining member to enter the receiving slot as the first and second table top are rotated from the folded position to the coplanar position and compress the spring and retract the retaining member into the first member until the coplanar position is reached and the retaining member is released to fully extend under pressure from the spring into the receiving slot.

2. The foldable table according to claims 1, wherein a wrenching member is engaged to the retaining member to extend out through a first slot in the first member so as to permit disengaging the retaining member from the receiving slot when moving the first and second table top from the coplanar operating position to the folded position.

3. The foldable table as defined in claim 1, wherein the first member of each of said pivoting device is provided with a second slot housing the retaining member.

4. The foldable table as defined in claim 1, wherein said retaining member is provided at a rear end thereof with a protruded portion extending rearward.

5. The foldable table as defined in claim 4, wherein said second slot houses the spring which urges between said protruded portion of said retaining member and said receiving slot, said protruded portion of said retaining member being inserted into said spring.

6. The foldable table as defined in claim 1, wherein the first and second table tops are provided in a same side with a hand grip fastened threrewith.

* * * * *